United States Patent [19]

Gaudenzi et al.

[11] Patent Number: 4,810,962

[45] Date of Patent: Mar. 7, 1989

[54] VOLTAGE REGULATOR CAPABLE OF SINKING CURRENT

[75] Inventors: Gene J. Gaudenzi, Purdys; Susan L. Tempest, Poughkeepsie, both of N.Y.

[73] Assignee: International Business Machines Corporation, Armonk, N.Y.

[21] Appl. No.: 111,732

[22] Filed: Oct. 23, 1987

[51] Int. Cl.[4] ..... G05F 3/16

[52] U.S. Cl. ..... 323/314; 323/313

[58] Field of Search ..... 323/313, 314, 407; 307/297

[56] References Cited

U.S. PATENT DOCUMENTS

| | | | |
|---|---|---|---|
| 3,534,245 | 10/1970 | Limberg | 323/4 |
| 3,716,722 | 2/1973 | Bryant et al. | 307/215 |
| 3,794,861 | 2/1974 | Bernacchi | 307/297 |
| 4,268,789 | 5/1981 | Nagano | 323/315 |
| 4,277,739 | 7/1981 | Priel | 323/313 |
| 4,287,467 | 9/1981 | Gloaguen | 323/314 |
| 4,292,583 | 9/1981 | Hoeft | 323/316 |
| 4,359,680 | 11/1982 | Hellums et al. | 323/313 |
| 4,396,883 | 8/1983 | Holloway et al. | 323/313 |
| 4,433,283 | 2/1984 | Gersbach | 323/314 |
| 4,528,496 | 7/1985 | Naokawa et al. | 323/315 |
| 4,533,842 | 8/1985 | Yang et al. | 307/455 |
| 4,558,238 | 10/1985 | Yamada et al. | 307/491 |
| 4,563,595 | 1/1986 | Bose | 307/290 |
| 4,574,205 | 3/1986 | Nagano | 307/297 |
| 4,575,647 | 3/1986 | Ashton et al. | 307/443 |
| 4,584,492 | 4/1986 | Sharp | 307/475 |
| 4,626,770 | 12/1986 | Price, Jr. | 323/313 |
| 4,628,248 | 12/1986 | Birrittella et al. | 323/314 |

OTHER PUBLICATIONS

IBM TDB vol. 14, No. 5, 10/71, p. 1495.
IBM TDB vol. 22, No. 12, 5/80, p. 5385.

*Primary Examiner*—Patrick R. Salce
*Assistant Examiner*—Marc S. Hoff
*Attorney, Agent, or Firm*—William T. Ellis

[57] ABSTRACT

A voltage regulator for regulating the voltage at a first node, comprising a first voltage supply;

a first node;

a first transistor with a control terminal connected to the first node;

a circuit for varying the VBE voltage drop of the first transistor in accordance with whether the voltage level of the first voltage supply is above or below a threshold voltage and for continuously sinking current from the first transistor; and a circuit for varying the voltage level at the current-emitting terminal of the first transistor to counteract, in combination with the varying VBE voltage drop, the change in the voltage level of the first voltage supply.

24 Claims, 1 Drawing Sheet

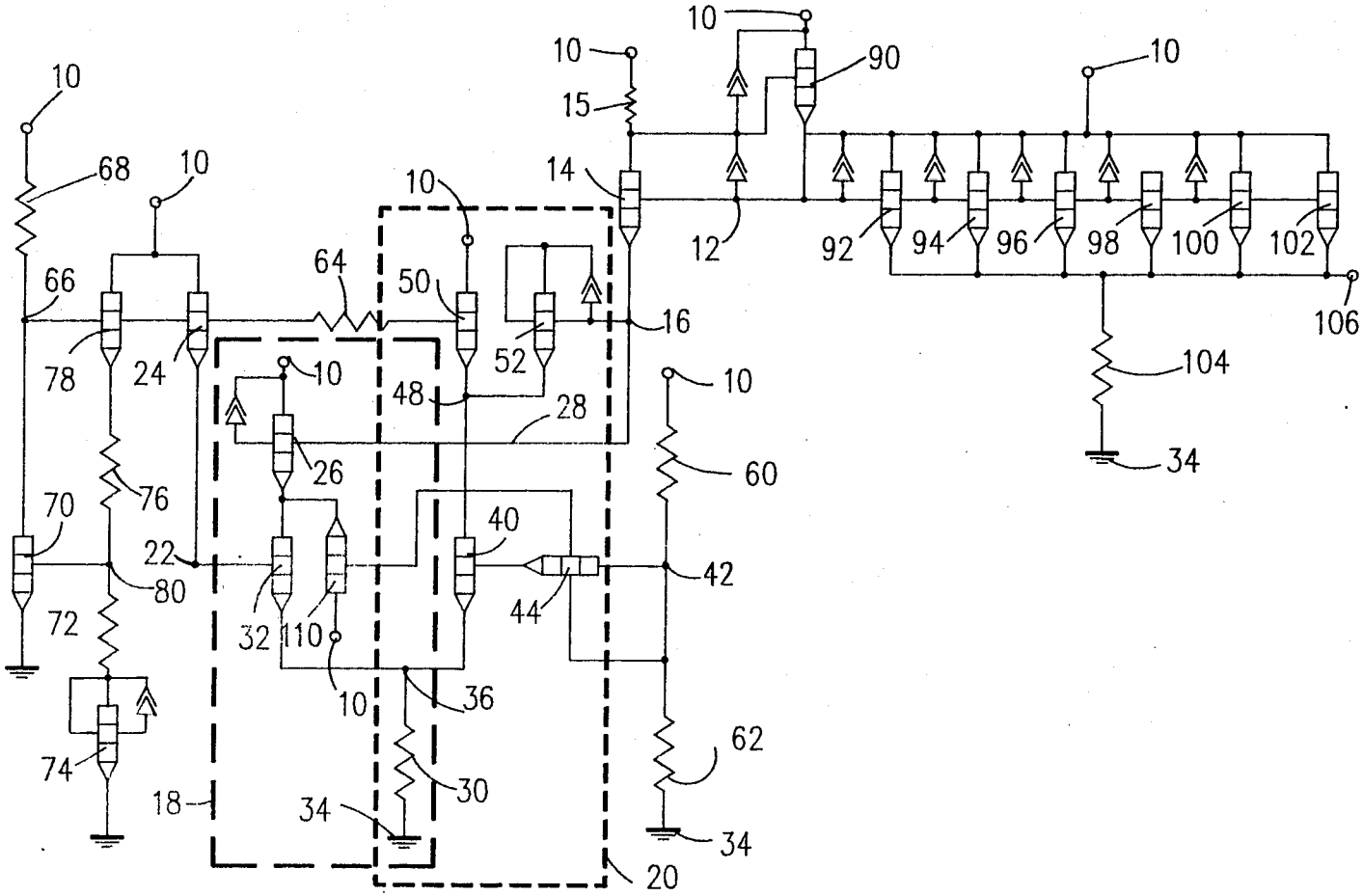
10
106
102
100
98
96
94
92
104
34
90
12
15
14
16
60
42
62
20
28
52
44
40
36
30
50
48
64
26
110
32
18
24
22
80
76
68
66
78
70
72
74

VOLTAGE REGULATOR CAPABLE OF SINKING CURRENT

BACKGROUND OF THE INVENTION

The present invention relates generally to voltage regulators, and more particularly to a voltage regulator that compensates for temperature, power supply and process variations.

It is necessary in a variety of diverse circuits to provide a regulated voltage at a given point in a circuit, which voltage does not vary despite temperature fluctuations, and voltage fluctuations in the power supply and the ground potential. In a number of applications the circuit that is to provide the regulated voltage must do so while sinking current.

Additionally, it has been discovered that in many applications it is especially critical to control and prevent the voltage supply from dropping below a given threshold voltage. In particular, it has been discovered that the most positive UP or high logic level for driver output lines and other line voltages occurs when the voltage supply drops to its lowest voltage level.

The present invention as claimed is directed to providing a regulated voltage despite temperature and power supply fluctuations, while at the same time sinking current. The invention is particularly directed to preventing the regulated voltage from dropping below a predetermined threshold. This regulated voltage is achieved without using PNP transistors.

The present invention is especially advantageous for controlling the most positive UP level for driver and other line voltage determining circuits. Accordingly, line switching pedestals within threshold regions reducing switching delays and the likelihood of false switching.

SUMMARY OF THE INVENTION

Briefly, the present invention is a voltage regulator for regulating the voltage at a first node, comprising

- a first voltage supply;
- a first node;
- a first transistor with a control terminal connected to the first node;
- means for varying the VBE voltage drop of the first transistor in accordance with whether the voltage level of the first voltage supply is above or below a threshold voltage; and
- means for varying the voltage level at the current-emitting terminal of the first transistor to counteract, in combination with varying the VBE voltage drop, the change in the voltage level of the first voltage supply.

In one embodiment of the present invention, the voltage regulator may further include means for compensating the voltage level at the first node for VBE variations caused by temperature fluctuations.

In a preferred embodiment of the present invention, the VBE varying means comprises

- first current channel means with a current control terminal connected via a first connection circuit to the first voltage supply, wherein when the first voltage supply has a voltage level below a threshold value, the first current channel means draws current greater than a first current level from the first transistor to provide a first VBE voltage drop across the first transistor; and

- second current channel means with a current control terminal connected via a second connection circuit to the first voltage supply, wherein when the first voltage supply has a voltage level above the threshold value, the second current channel draws a current at a second level which is less than the first level to provide a second VBE voltage drop across the first transistor which is less than the first VBE voltage drop.

In one embodiment, the first current channel means may comprise a second transistor and a current path from the current-emitting terminal of the first transistor to the control terminal of the second transistor.

In a further embodiment of the present invention, the first and second current channel means may form a current switch circuit.

In a further embodiment of the present invention, the voltage level varying means may comprise

- a third transistor with its current-emitting terminal connected to influence the voltage at the current-emitting terminal of the first transistor; and
- first resistance means connected at one end to the control terminal of the third transistor for decreasing the voltage at the control terminal as the voltage level of the first voltage supply increases.

In yet a further embodiment of the present invention, the voltage regulator may include

- a second node connected to the other end of the first resistance means;
- second resistance means connected between the first voltage supply and the second node;
- means for drawing current through the second node which is not affected by temperature variations;
- wherein the first connection circuit comprises a transistor with its control terminal connected to the second node and operating to provide current to the control terminal of the first current control means. The second connection circuit may comprise a voltage divider circuit, with one end thereof connected to the first voltage supply and including a terminal at a voltage division point such that when the first voltage supply is above the threshold value, then the second current channel means draws more current than the first current channel means.

In a further embodiment of the present invention, the second current channel means may be connected to draw current from the current-emitting terminal of the third transistor.

BRIEF DESCRIPTION OF THE DRAWING

The FIGURE is a schematic circuit diagram of one embodiment of the present invention.

DETAILED DESCRIPTION OF THE PREFERRED EMBODIMENT

The present invention will be described in the context of a specific circuit embodiment. However, the teachings of applicants' invention are not limited to this particular circuit configuration, but rather may be embodied in a number of different circuit configurations. Additionally, the present invention will be described in the context of a circuit implemented using NPN transistors. It is, of course, understood by one skilled in the art that the invention is not limited to this particular type of transistor. In this regard, any appropriate switching device may be substituted for the NPN transistors shown in the FIGURE.

It should be noted that for purposes of interpreting the claims, the term "current-emitting terminal" in the claims is intended to include bipolar emitter terminals and field effect transistor source terminals. Likewise, the term "control terminal" is intended to include bipolar transistor base terminals and field effect transistor gate terminals. Finally, the term "current-collecting terminal" is intended to include bipolar transistor collector terminals and field effect transistor drain terminals.

Referring now to FIG. 1, there is shown one embodiment of the present invention. In this embodiment, there is provided a first voltage supply 10, a first node 12, and a first transistor 14 with a control terminal connected to the first node 12, a collector terminal connected to the first voltage supply 10 via a resistor 15, and an emitter terminal connected to a node 16. Also included is circuitry to embody a means for varying the VBE voltage drop of the first transistor 14 in accordance with whether the voltage level of the first voltage supply 10 is above or below a predetermined threshold voltage. This variation in the VBE voltage drop of the first transistor 14 may be accomplished by varying the level of the current drawn through this transistor. The FIGURE further includes means for varying the voltage level at the current-emitting terminal of the first transistor 14 to counteract, in combination with varying the VBE voltage drop of the first transistor 14, the change in the voltage level of the first voltage supply 10. Finally, this FIGURE includes means for compensating the voltage level at the first node for VBE variations caused by changes in temperature.

The means for varying the VBE voltage drop of the first transistor 14 will now be discussed in detail. Although a number of circuit configurations may be utilized to implement this function, in a preferred embodiment, the VBE varying means comprises a first current channel means, designated generally to include the devices within the dashed line box 18, and a second current channel means, designated generally as including the devices within the dashed line box 20. The first current channel means has a current control terminal 22 which is connected via a first connection circuit 24 to the first voltage supply 10. In the embodiment shown in the Figure, this first connection circuit is implemented by a transistor 24 with its collector connected to the first voltage supply 10, and with its emitter connected to the current control terminal 22. The first current channel means 18 is designed so that when the first voltage supply 10 has a voltage level below a predetermined threshold value, then the first current channel means 18 draws current which is greater than a first current level from the first transistor 14 to thereby provide a first VBE voltage drop across the first transistor. In the embodiment shown in the FIGURE, the first current channel means includes a second transistor 26, and a current path 28 from the current-emitting terminal 16 of the first transistor 14 to the control terminal of the second transistor 26. In this embodiment, the second transistor 26 has its collector terminal connected to the first voltage supply 10. The first current channel means further includes a current source 30 and a first current control means 32. In the embodiment shown in the FIGURE, the current source 30 comprises simply a resistor 30 with one end thereof the connected to a second voltage supply 34 and with the other end thereof connected to a terminal 36. The first current control means 32 is implemented by means of a transistor 32 with its collector connected to the emitter of the second transistor 26 and with its emitter connected to the other end 36 of the resistor 30. The base of the transistor 32 is connected to the current control terminal 22 of the first current channel means 18.

The second current channel means 20 includes a second current control means 40 including the second current channel means control terminal 42. The second current control means 40 is connected to the current source 30 for drawing current therefrom in accordance with the voltage on the control terminal 42 for the second current channel means. In the embodiment shown in the FIGURE, the second current control means 40 is implemented by a transistor 40 with its emitter terminal connected to terminal 36 for the current supply 30. The base terminal for the transistor 40 is connected via a diode 44 (a collector-base shorted transistor) to the control terminal 42 for the second current channel means 20. The diode 44 is included in order to compensate for the VBE voltage drop of the transistor 24.

The second current channel means 20 further includes means for splitting the current from the second current control means 40 into a first and a second split currents, with the second split current being applied to the current-emitting terminal 16 of the first transistor 14. There are a number of configurations which could be utilized to accomplish this current splitting function. In the embodiment shown in the FIGURE, a transistor 50 is disposed with its collector terminal connected to the first voltage supply 10, and with its emitter terminal connected to the collector terminal 48 for the second current control means transistor 40. This transistor 50 is utilized to draw the first split current. A second device 52 is also connected to the collector terminal 48 for the transistor 40 to draw the second split current. In the embodiment shown in the FIGURE, this second device 52 is implemented by a diode (a base-collector shorted transistor) with the cathode of this diode 52 connected to the terminal 48 and with the anode of the diode 52 connected to the terminal 16. In the embodiment shown in the FIGURE, the second connection circuit for connecting the control terminal 42 for the second current channel means to the first voltage supply 10 comprises a voltage divider circuit. This voltage divider circuit comprises a resistor 60 and a resistor 62. The resistor 60 has one end thereof connected to the first voltage supply 10 and has its other end connected to the control terminal 42. The resistor 62 has one end thereof connected to the control terminal 42 and the other end thereof connected to the second voltage supply 34. The resistor values for the resistors 60 and 62 are chosen so that when the first voltage supply 10 has a voltage level which is above the predetermined threshold value, then the voltage at the control terminal 42 will be such that the second current control means 40 will draw more current from the current source 30 than the first current control means 32. In essence, the voltage divider resistance values are set so that the current drawn by the transistor 40 overtakes the current drawn by the transistor 32 at a predetermined threshold voltage for the first voltage supply 10. For first voltage supply levels above this threshold voltage, transistor 40 will draw progressively more current from the current source 30 relative to the transistor 30. By way of example, a typical threshold voltage for the first voltage supply 10 might be 5 volts. For this threshold voltage, the resistors 60 and 62 could take the values 6K ohms and 9.4K ohms, respectively.

It should be noted that the first and second current channel means 18 and 20 are connected to form a current switch configuration.

As noted above, the circuit further includes means for varying the voltage level at the current-emitting terminal 16 for the first transistor 14 to counteract changes in the voltage level of the first voltage supply 10. The voltage level varying means, in the embodiment shown in the FIGURE, comprises a third transistor with its current-emitting terminal connected to directly influence the voltage at the current-emitting terminal of the first transistor 14. This third transistor is conveniently implemented by the transistor 50 which is disposed with its collector connected to the first voltage supply 10 and with its emitter connected to the terminal 48 to have the first split current applied thereto. The voltage level varying means further includes resistance means 64 which is connected between a second node 66 (having a voltage indicative of the voltage level of the first voltage supply 10) and the control terminal of the third transistor 50. This resistance means 6 operates to change the voltage at the control terminal of the transistor 50 to counteract changes in the voltage level of the first voltage supply 10.

In the embodiment shown in the FIGURE, the second node 66 is connected via a resistor 68 to the first voltage supply 10. A transistor 70 is included to draw current through the resistor 68 and the second node 66 to obtain a voltage level at the second node which is indicative of the voltage level of the first voltage supply 10. In the configuration shown in the FIGURE, the transistor 70 is disposed with its collector connected to the second node 66 and with its emitter connected to the second voltage supply 34.

In operation of the VBE voltage varying circuit, for the first case where the first voltage supply 10 has a voltage above the predetermined threshold value, the voltage divider comprising the resistors 60 and 62 causes the voltage at the control terminal 42 to rise. This rise in voltage at the control terminal 42 is provided via the diode 44 to the base of the second current control transistor 40 to increase the current drawn therethrough. This increased voltage at the base for the transistor 40 causes the voltage at the terminal 36 to rise by a comparable amount. However, this rise in the voltage at the terminal 36 decreases the VBE voltage drop between the terminals 22 and 36 for the first current control transistor 32. Accordingly the current drawn through the transistor 32 decreases. The result of this circuit action is that more current is drawn by the transistor 40 through the transistor 50 and the diode 52. However, because this current is split into a first split current and a second split current, the increase in current drawn from the emitter terminal 16 of the first transistor 14 to the anode of the diode 52 is negligible. Additionally, the current drawn by the diode 52 is limited by the fact that the transistor 40 is biased to sink a given amount of current, and most of that current is drawn from the transistor 50. In this regard, the current path for the diode 52 includes the first transistor 14 and the resistor 15. Typically, the resistor 15 is a large resistor on the order of 3K ohms. Thus, the current path through the diode 52 is a high impedance path. Accordingly, the VBE voltage drop between the terminals 12 and 16 varies only slightly for increased voltage levels at the first voltage supply 10.

However, an increased voltage level at the first voltage supply 10 results in an increased voltage at the second node 66. This increased voltage at the second node 66 is applied via the resistor 64 to the control terminal for the transistor 50 to make that transistor more conductive. Note also that the second current control transistor 40 is drawing more current in view of the voltage divider action of the resistors 60 and 62. Thus, more current is drawn through the resistor 64 to the control terminal of the transistor 50, causing a counteracting increase in the voltage drop across the resistor 64. The resulting lower voltage at the base of the transistor 50 is then translated by one VBE voltage drop of the transistor 50 to the terminal 48. This lower voltage at the terminal 48 is translated UP by the diode voltage drop of the diode 52 to the terminal 16. The first transistor 14 translates this lower voltage at the terminal 16 up by one VBE voltage drop to the first node 12. Accordingly, the voltage level increase of the first voltage supply 10 above its predetermined threshold has been compensated by an increased voltage drop across the resistor 64 and an increased VBE drop across the transistor 50 (translated to the terminal 16). The low current through the first transistor 14 ensures that any change in VBE across the first transistor 14 is nominal.

Likewise, when the voltage level of the first voltage supply 10 drops below the predetermined threshold level, then the first current channel means 18 operates to draw more current therethrough. In this regard, the voltage divider comprising the resistors 60 and 62 operates to divide the voltage from the first voltage supply 10 so that when this voltage supply level drops below the predetermined threshold level, the voltage at the control terminal 42 is such that the transistor 40 in the second current channel means 20 draws less current than the transistor 32 in the first current channel means 18. As more current is drawn through the transistor 32, this results in more current being drawn through the transistor 26 and in particular, from the emitter terminal 16 through the base terminal for the transistor 26. Because the current drawn through the base of the transistor 26 is greater than the current drawn through the diode 52 when the first voltage supply 10 is above its threshold level, then the VBE voltage drop for the first transistor 14 increases by an amount of on the order of 0.1–0.2 mv.

Additionally, as more current is drawn through the transistor 32 and less current is drawn through the transistor 40 of the second current channel means 20, then less current is drawn through the resistor 64 and the transistor 50. The result of this operation is that there is a smaller voltage drop across the resistor 64 so that a higher voltage is provided at the base of the transistor 50. This higher voltage at the base of the transistor 50 is then translated by a VBE voltage drop down to the terminal 48, and is then translated up by the voltage drop of the diode 52 to the emitter terminal 16. Accordingly, it can be seen that a low voltage level at the second node 66 which is connected to the first voltage supply 10, is translated with a smaller voltage drop through the resistor 64 and the VBE of the transistor 50 to the terminal 48. The voltage at the terminal 48 is then translated through the diode voltage drop of the diode 52 and the VBE for the first transistor 14 to the first node 12. The larger current drawn from the first transistor 14 via the base of the transistor 26 ensures that the VBE voltage drop for the first transistor 14 is increased. Thus, a decrease in the voltage level of the first voltage supply 10 below a predetermined threshold is compensated for at the first node 12.

As an added feature, means may be provided for increasing the switching speed of the current switch when the first current channel 18 begins to conduct the majority of current relative to the second current channel means 20. This may be accomplished by decreasing the voltage at the control terminal 42 for the second current channel means 20. This switching speed increasing means may, in one embodiment, comprise a transistor 110 with its base terminal connected to draw current from the control terminal 41 of the second current control means 20 to thereby reduce the base bias voltage for the transistor 40. In the embodiment shown in the FIGURE, the transistor 110 has its collector connected to the first voltage supply 10 and its emitter connected to the collector of the first current control transistor 32. This transistor 110, when the transistor 32 starts to conduct the majority of the current in the current switch, acts to draw more current through the resistor 60 in the voltage divider, resulting in a fast voltage drop at the base of the transistor 40, and a sharper current switching action between the transistors 40 and 32. The addition of the transistor 110 provides a voltage regulation improvement of 3–5 mV.

As noted previously, the present voltage regulator further includes means for compensating the voltage level of the first node 12 for VBE temperature variations in the circuit. The temperature compensation circuit is connected to the second node 66 and the transistor 70 and operates to ensure that variations in the VBE for the transistor 70 do not alter the level of the current drawn through the resistor 68. This temperature compensation circuit comprises the disposal of a resistor 72 and a diode 74 (a transistor with its collector and base shorted) connected in parallel with the base-emitter junction of the transistor 70. However, the diode 74 that is utilized is purposely designed to be a much larger physical device than the transistor 70 so that the VBE of the diode 74 is lower than the VBE of the transistor 70. This lower VBE for the diode 74 ensures that current flows through the resistor 72. Note, however, that although the VBEs for the transistors 70 and 74 are different, both VBEs will change by the same amount in response to a temperature variation.

The circuit further includes an additional resistor 76 connected in series with the resistor 72 to form a voltage divider circuit, with a transistor 78. The transistor 78 is disposed with its collector terminal connected to the first voltage supply 10, with its base terminal connected to the second node 66, and with its emitter terminal connected to one end of the resistor 76. The base terminal for the transistor 70 is connected to the series connection terminal 80 between the resistors 76 and 72.

A proper choice of values for the resistors 72 and 76 will set a desired bias voltage at the base of the transistor 70 to provide a desired voltage level at the second node 66 when the first voltage supply 10 is at its threshold level. By way of example, for a resistor 68 value of 14 Kohms, the resistors 76 and 72 may take the values 11.25 kohms and 0.5 kohms, respectively.

The foregoing circuit operates as follows in order to achieve temperature compensation. It can be seen that because the base-emitter junction for the transistor 70 is connected in parallel with the base-emitter junction for the diode 74, any change in the VBE for the transistor 70 will be identically tracked by the change in the VBE for the diode 74. In essence, for a constant first voltage supply level, the voltage across the resistor 72 is constant. Accordingly, the resistor 72 essentially acts as a constant current source for providing a bias voltage to a transistor 70. It should also be noted that the value for the resistor 68 may be purposely chosen to be large to ensure that the current drawn by the transistor 70 is small. Such a small current through the transistor 70 also minimizes any change in the VBE for transistor 70 due to temperature.

It should be noted that the voltage divider operation of the resistor 72 and 76 in the temperature compensation circuit provides an additional means for compensating for changes in the voltage level of the first voltage supply 10. For example, if the voltage of the first voltage supply 10 rises above its predetermined threshold value, then the voltage at the second node 66 rises accordingly. This increased voltage level at the second node 66 increases the current drawn through the transistor 78 in the temperature compensation circuit, and raises the voltage at the emitter of the transistor 78. Accordingly, this increased voltage at the emitter of the transistor 78 will be divided so that the voltage at the control terminal 80 for the transistor 70 increases in value. Accordingly, the transistor 70 draws more current through the resistor 68, thereby dropping the voltage at the node 66.

Likewise, it can be seen that if the voltage level of the first voltage supply 10 drops below the predetermined threshold value, then the voltage level at the second node 66 will drop in value. This results in a lower voltage at the emitter terminal of the transistor 78 and at the control terminal 80 for the transistor 70, so that the transistor 70 draws less current through the resistor 68. Accordingly, the voltage level at the second node 66 rises in value.

The designer may conveniently include Schottky barrier diodes across the collector and base terminals of selected transistors where transistor saturation is anticipated. A number of such Schottky diodes are shown in the FIGURE.

There are a variety of circuits which may be configured to utilize the regulated voltage at the first node 12. One of these many circuits is shown in the FIGURE. This circuit configuration is a Darlington circuit comprising a transistor 90 for feeding the base terminals of a plurality of parallel connected transistors 92, 94, 96, 98, 100, and 102. The transistor 90 is disposed with its collector terminal connected to the first voltage supply 10, with its base terminal connected to the collector terminal for the first transistor 14, and with its emitter terminal connected to the first node 12. The transistors 92–102 are all connected in parallel, with their collector terminals connected to the first voltage supply 10, with their base terminals connected to the first node 12, and with their emitter terminals connected to the second voltage supply 34 via a resistor 104. The plurality of parallel connected transistors 92–102 are utilized for reliability purposes to split-up the current supplied by the circuit. The voltage at the first node 12 is translated by one VBE voltage drop down to a third node 106, for use by later circuits.

The present voltage regulator circuit features compensation for both temperature and power supply variation to provide a regulated voltage at the first node 12. This circuit will provide a regulated voltage while sinking or sourcing current. In one embodiment of this circuit, the voltage level at the first node 12 was properly regulated with the use of a power supply which varied from 4.5V to 5.5V, with a ground shift which varied from −0.015V to +0.125V and over a temperature range of from 10° C. to 100° C.

The present voltage regulator circuit can be used with a variety of different circuit applications, including drivers and receivers. This circuit has the ability, in particular, to sink current at all times through the transistor 14 while it is performing its voltage regulation function.

The present invention is particularly advantageous for controlling the most positive UP level for driver and other line voltage determining circuits. Accordingly, line switching pedestals can be avoided, reducing switching delays and the likelihood of false switching.

It can be seen from the previous description that the present invention provides a unique three-way method for controlling the voltage at the first node 12. In this regard, one method encompasses the use of the current switch with the transistors 32 and 40 drawing varying amounts of current through the first transistor 14 to thereby vary the VBE for that transistor. Additionally, the transistor 50 in combination with the resistor 64 operate to vary the voltage at the emitter terminal 16 for the first transistor 14 in accordance with the voltage level of the first voltage supply 10. Finally, the voltage divider action of the resistors 72 and 76 in their feedback relationship with the transistor 70, the transistor 78, and the second node 66, operate to compensate for changes in the first voltage supply 10.

An added feature of the present invention is that the current switch with its dual connections to the emitter terminal 16, is capable of sinking current through the circuit regardless of whether the first voltage supply 10 is above or below its predetermined threshold voltage. Additionally, the circuit includes a temperature compensation configuration for compensating for variations in the VBE for the transistor 70.

While the present invention has been particularly shown and described with reference to preferred embodiments therefor, it will be understood by those skilled in the art that the foregoing and other changes in form and detail may be made therein without departing from the spirit and the scope of the present invention.

We claim:

1. A voltage regulator for regulating the voltage at a first node, comprising a first voltage supply;

a first node;

a first transistor with a control terminal connected to said first node;

means for varying the VBE voltage drop for said first transistor in accordance with whether the voltage level of said first voltage supply is above or below a threshold voltage, and for continuously sinking current from said first transistor; and means for varying the voltage level at the current-emitting terminal of said first transistor to counteract, in combination with said varying VBE voltage drop, any change in the voltage level of said first voltage supply.

2. A voltage regulator as defined in claim 1, further comprising:

means for compensating the voltage level at said first node for VBE changes caused by temperature variations.

3. A voltage regulator as defined in claim 1, wherein said VBE varying means comprises first current channel means including a current control terminal connected via a first connection circuit to said first voltage supply, wherein when said first voltage supply has a voltage level below a threshold value, said first current channel means draws current greater than a first current level from said first transistor to provide a first VBE voltage drop across said first transistor; and second current channel means including a current control terminal connected via a second connection circuit to said first voltage supply, wherein when said first voltage supply has a voltage level above said threshold value, said second current channel draws a current at approximately a second level which is less than said first level to provide a second VBE voltage drop across said first transistor which is less than said first VBE voltage drop.

4. A voltage regulator as defined in claim 3, wherein said first current channel means comprises a second transistor and a current path from the current-emitting terminal of said first transistor to the control terminal of said second transistor.

5. A voltage regulator as defined in claim 3, wherein said first and second current channel means form a current switch.

6. A voltage regulator as defined in claim 5, wherein current switch includes a first current source and wherein said first current channel means comprises a second transistor;

a current path from the current-emitting terminal of said first transistor to the control terminal of said second transistor; and first current control means including said control terminal for said first current channel means, said first current control means connected between said first current source and the current-emitting terminal of said second transistor for controlling the current flowing through the control terminal of said second transistor in accordance with the voltage level on said first voltage supply.

7. A voltage regulator as defined in claim 6, wherein second current channel means comprises second current control means including said control terminal for said second current channel means, said second current control means connected to said current source for drawing current therefrom in accordance with the voltage on said control terminal for said second current channel means; and means for splitting the current from the second current control means into a first and a second split currents, said second split current being applied to said current-emitting terminal of said first transistor.

8. A voltage regulator as defined in claim 7, wherein said voltage level varying means comprises:

a second node;

first resistance means connected between said first voltage supply and said second node;

means for drawing current through said first resistance means and said second node;

a third transistor with its current-emitting terminal connected to influence the voltage at the current-emitting terminal of said first transistor and connected to have said first split current applied thereto; and second resistance means connected between said second node and the control terminal of said third transistor for changing the voltage at said control terminal to counteract changes in the voltage level of said first voltage supply.

9. A voltage regulator as defined in claim 8, wherein said current drawing means comprises a fourth transistor with its current-collecting terminal connected to draw current from said second node;

a fifth transistor with its control terminal connected to said second node;

a first resistor connected between the current-emitting terminal of said fifth transistor and the control terminal of said fourth transistor;

a second resistor and a diode connected in series with each other, with this series connected second resistor and diode connected in parallel with the base-emitter junction of said fourth transistor, wherein said diode compensates for VBE temperature variations in said fourth transistor, and wherein a change in the voltage at said second node causes a similar change in the voltage at the control terminal of said fourth transistor, to thereby change the current drawn through said fourth transistor and said first resistance means to compensate for the voltage change at said second node.

10. A voltage regulator as defined in claim 8, wherein said first connection circuit comprises a transistor with its control terminal connected to said second node and operating to provide current to the control terminal of said current control means.

11. A voltage regulator as defined in claim 10, wherein said second connection circuit comprises a connected to said first voltage supply, and including a terminal at a voltage division point such that when said first voltage supply is above said threshold value, then said second current control means draws more current from said current source than said first current control means.

12. A voltage regulator as defined in claim 11, wherein said first current .control means comprises a transistor with its current-emitting terminal connected to said first current source, with its current-collecting terminal connected to the current-emitting terminal of said second transistor, and with its base terminal comprising the control terminal for said first current channel means; and wherein said second current control means comprises a transistor with its current-emitting terminal connected to said first current source, with its current-collecting terminal connected to said splitting means, and with its base terminal comprising the control terminal for said second current channel means.

13. A voltage regulator as defined in claim 12, wherein said first current channel means further includes means for increasing the switching speed of said current switch when said first current channel means begins to conduct the majority of current relative to said second current channel means by decreasing the voltage at the control terminal for said second current channel means.

14. A voltage regulator as defined in claim 13, wherein said switching speed increasing means comprises a transistor with its base terminal connected to draw current from the control terminal of said second current channel means to thereby reduce the base bias voltage for said transistor in said second current control means.

15. A voltage regulator as defined in claim 1, wherein said voltage level varying means comprises:

a second node;

first resistance means connected between said voltage supply and said second node;

means for drawing current through said first resistance means and said second node;

a third transistor with its current-emitting terminal connected to influence the voltage at the current-emitting terminal of said first transistor and connected to have said first split current supplied thereto; and second resistance means connected between said second node and the control terminal of said third transistor for changing the voltage at said control terminal to counteract changes in the voltage level of said first voltage supply.

16. A voltage regulator as defined in claim 15 wherein said current drawing means comprises a fourth transistor with its current-collecting terminal connected to draw current from said second node;

a fifth transistor with its control terminal connected to said second node;

a first resistor connected between the current-emitting terminal of said fifth transistor and the control terminal of said fourth transistor;

a second resistor and a diode connected in series with each other, with this series connected second resistor and diode connected in parallel with the base-emitter junction of said fourth transistor, wherein said diode has a different VBE compared to said fourth transistor;

wherein said diode compensates for VBE temperature variations in said fourth transistor, and wherein a change in the voltage at said second node causes a similar change in the voltage at the control terminal of said fourth transistor, to thereby change the current drawn through said fourth transistor and said first resistance means compensate for the voltage change at said second node.

17. A voltage regulator as defined in claim 1, wherein said VBE varying means comprises a current switch with a first and second current channels each with a respective control terminal, connected to draw the majority of current from said first transistor through said first current channel if the voltage of said first voltage supply is below said threshold voltage, and to draw the majority of current through said second current channel if the voltage of said first voltage supply is above said threshold voltage.

18. A voltage regulator as defined in claim 17, wherein said current switch further includes means for increasing the switching speed of said current switch when said first current channel begins to conduct the majority of current by decreasing the voltage at the control terminal for said second current channel.

19. A voltage regulator for regulating the voltage at a first node, comprising:

a first voltage supply;

a first node;

a first transistor with a control terminal connected to said first node;

a current switch circuit including a first current channel means with a current control terminal connected via a first connection circuit to said first voltage supply, wherein when said first voltage supply has a voltage level below a threshold value, said first current channel draws a current greater than a first current level from said first transistor to provide a first VBE voltage drop across said first transistor;

second current channel means with a current control terminal connected via a second connection circuit to said first voltage supply, wherein when said first voltage supply has a voltage level above said threshold value, said second current channel means draws a current at a second level from said first transistor which is less than said first level to provide a second VBE voltage drop across said first transistor which is less than said first VBE voltage drop, to thereby regulate the voltage at said first node.

20. A voltage regulator as defined in claim 19, wherein said first current channel means comprises a second transistor and a current path from the current-emitting terminal of said first transistor to the control terminal of said second transistor.

21. A voltage regulator as defined in claim 20, wherein said voltage level varying means comprises:

a second node;

first resistance means connected between said first voltage supply and said second node;

means for drawing current through said first resistance means and said second node;

a third transistor with its current-emitting terminal connected to influence the voltage at the current-emitting terminal of said first transistor and connected to have said first split current applied thereto; and second resistance means connected between said second node and the control terminal of said third transistor for changing the voltage at said control terminal to counteract changes in the voltage level of said first voltage supply.

22. A voltage regulator as defined in claim 21, wherein said current drawing means comprises a fourth transistor with its current-collecting terminal connected to draw current from said second node;

a fifth transistor with its control terminal connected to said second node;

a first resistor connected between the current-emitting terminal of said fifth transistor and the control terminal of said fourth transistor;

a second resistor and a diode connected in series with each other, with this series connected second resistor and diode connected in parallel with the base-emitter junction of said fourth transistor, wherein said diode compensates for VBE temperature variations in said fourth transistor, and wherein a change in the voltage at said second node causes a similar change in the voltage at the control terminal of said fourth transistor, to thereby change the current drawn through said fourth transistor and said first resistance means to compensate for the voltage change at said second node.

23. A voltage regulator as defined in claim 22, wherein said second current channel means is connected to draw current from the current-emitting terminal of said third transistor.

24. A voltage regulator as defined in claim 23, wherein said second connection circuit comprises a voltage divider circuit, with one end thereof connected to said first voltage supply and including a terminal at a voltage division point such that when said first voltage supply is above said threshold value, then said second current channel means draws more current from said current source than said first current channel means.

* * * * *

UNITED STATES PATENT AND TRADEMARK OFFICE

CERTIFICATE OF CORRECTION

PATENT NO. : 4,810,962

DATED : March 7, 1989

INVENTOR(S) : G.J. Gaudenzi, S.L. Tempest

It is certified that error appears in the above-identified patent and that said Letters Patent is hereby corrected as shown below:

Column 4, line 66, change the number "30" to --32--

Column 5, line 23, change the number "6" to --64--

Column 11, line 31, after "comprises a" insert --voltage divider circuit, with one end thereof--

Signed and Sealed this

Fifth Day of June, 1990

*Attest:*

HARRY F. MANBECK, JR.

*Attesting Officer*

*Commissioner of Patents and Trademarks*